US007478957B1

(12) United States Patent
Thornton

(10) Patent No.: US 7,478,957 B1
(45) Date of Patent: Jan. 20, 2009

(54) LOTION APPLICATION APPARATUS

(76) Inventor: Willie R. Thornton, 2098 Brentwood Cove, Ellenwood, GA (US) 30294

( * ) Notice: Subject to any disclaimer, the term of this patent is extended or adjusted under 35 U.S.C. 154(b) by 0 days.

(21) Appl. No.: 11/936,997

(22) Filed: Nov. 8, 2007

(51) Int. Cl.
*A46B 11/00* (2006.01)
*A47L 13/22* (2006.01)
*A47K 3/22* (2006.01)

(52) U.S. Cl. ..... 401/48; 401/174; 401/277; 4/604; 15/21.1; 15/160

(58) Field of Classification Search ..... 401/48, 401/270, 277, 174; 15/21.1, 160; 4/597, 4/604, 605, 606
See application file for complete search history.

(56) References Cited

U.S. PATENT DOCUMENTS

| | | | | | |
|---|---|---|---|---|---|
| 398,731 | A * | 2/1889 | James | 607/82 |
| 544,362 | A * | 8/1895 | Lyons | 4/559 |
| 1,297,980 | A * | 3/1919 | Weinberger | 4/559 |
| 1,488,076 | A * | 3/1924 | Tebo | 4/606 |
| 4,171,171 | A | 10/1979 | Jones | |
| 4,817,227 | A * | 4/1989 | Scott | 15/21.1 |
| 5,105,484 | A * | 4/1992 | Forsythe | 4/606 |
| 5,322,382 | A | 6/1994 | Hull et al. | |
| 5,961,235 | A | 10/1999 | Kennedy | |
| 6,247,862 | B1 | 6/2001 | Garza | |
| 6,280,108 | B1 | 8/2001 | Haining et al. | |
| 6,550,996 | B1 | 4/2003 | Rayfield | |
| D523,173 | S | 1/2006 | Angeletta | |
| 7,086,796 | B2 | 8/2006 | Severa | |

* cited by examiner

*Primary Examiner*—David J Walczak

(57) ABSTRACT

A lotion application apparatus includes a base that has an apex. A post is attached to and extends upwardly from the apex of the base. A support is attached to a distal end of the post with respect to the base. The support is elongated and has a first end and a second end. The support is attached to the post between the first and second ends. An arm is attached to the second end of the support and extends downwardly from the support. A bottom end of the arm comprises a grip. The arm is used to rotate the support along a longitudinal axis of the support with respect to the post. A brush assembly is mounted to the support and dispenses lotion for positioning on a person.

17 Claims, 5 Drawing Sheets

LOTION APPLICATION APPARATUS

BACKGROUND OF THE INVENTION

Field of the Invention

The present invention relates to lotion application devices and more particularly pertains to a new lotion application device for assisting a person in placing lotion on their back.

SUMMARY OF THE INVENTION

The present invention meets the needs presented above by generally comprising a base that has an apex. A post is attached to and extends upwardly from the apex of the base. A support is attached to a distal end of the post with respect to the base. The support is elongated and has a first end and a second end. The support is attached to the post between the first and second ends. An arm is attached to the second end of the support and extends downwardly from the support. A bottom end of the arm comprises a grip. The arm is used to rotate the support along a longitudinal axis of the support with respect to the post. A brush assembly is mounted to the support and dispenses lotion for positioning on a person.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such descriptions makes reference to the annexed drawings wherein.

DESCRIPTION OF THE PREFERRED EMBODIMENT

Figure 1:
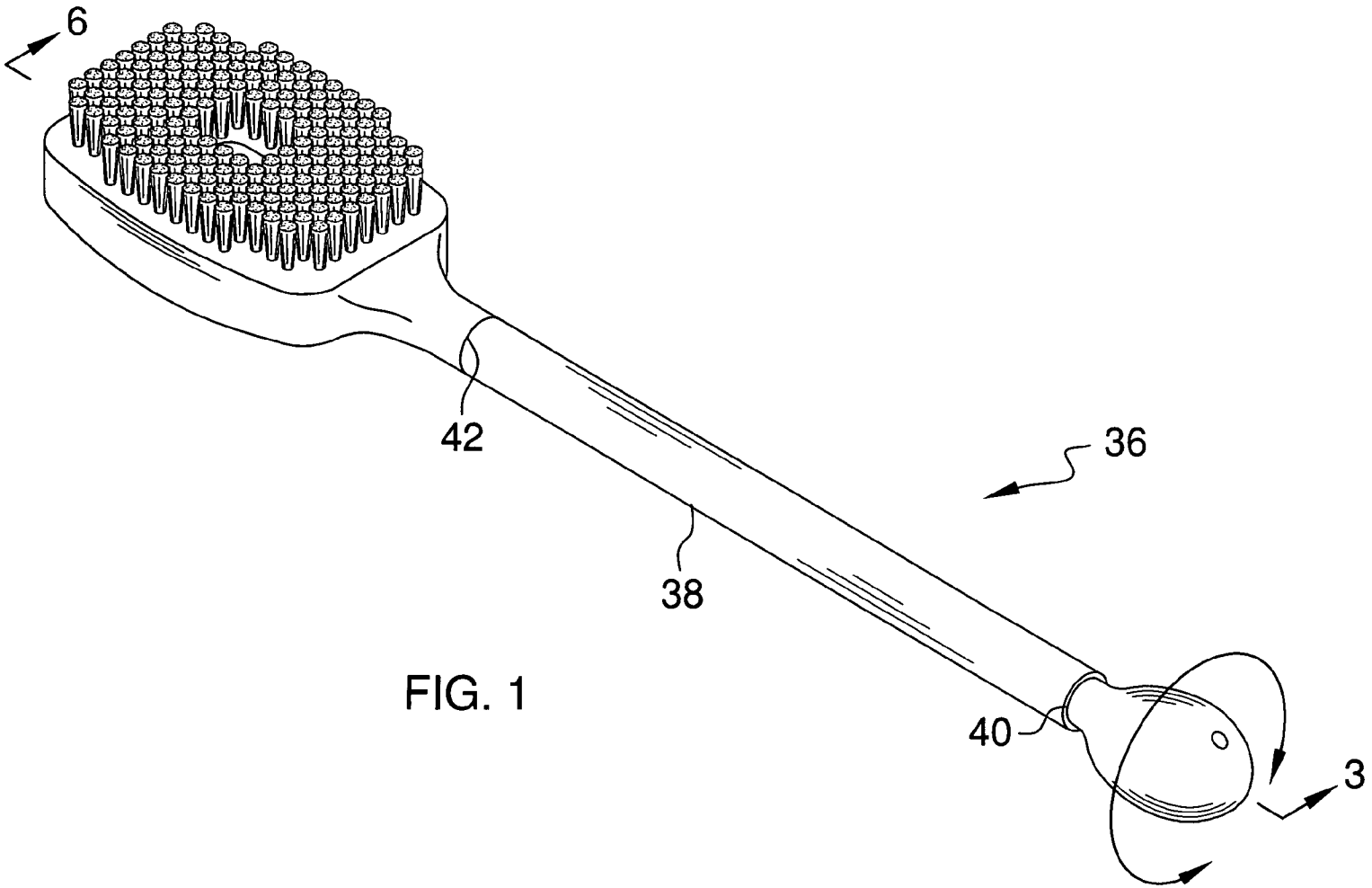
FIG. 1 is a perspective view of a brush assembly of a lotion application apparatus according to the present invention.
Figure 2:
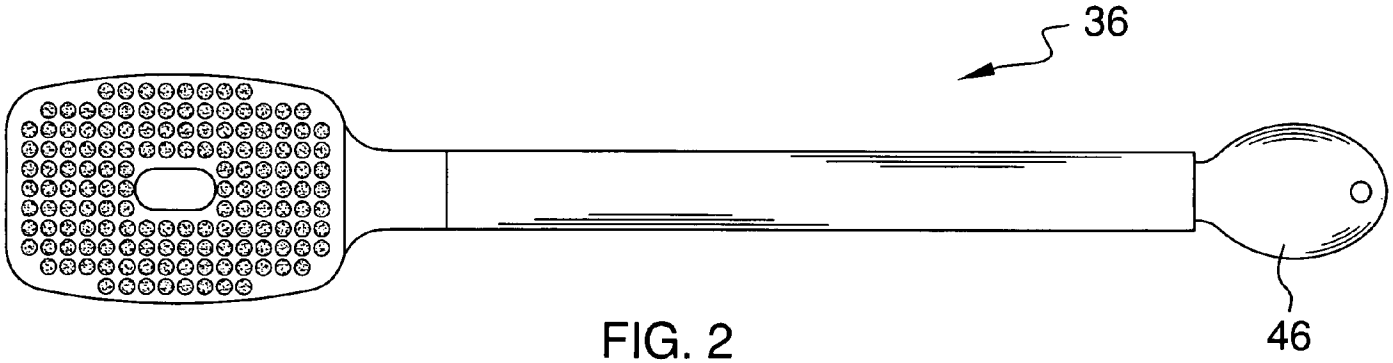
FIG. 2 is a front view of the brush assembly of the present invention.
Figure 3:
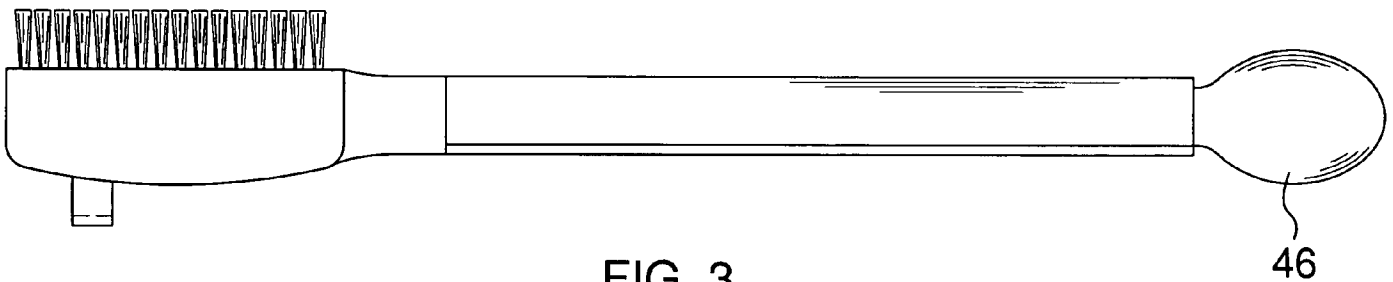
FIG. 3 is a side view of the brush assembly of the present invention.
Figure 4:
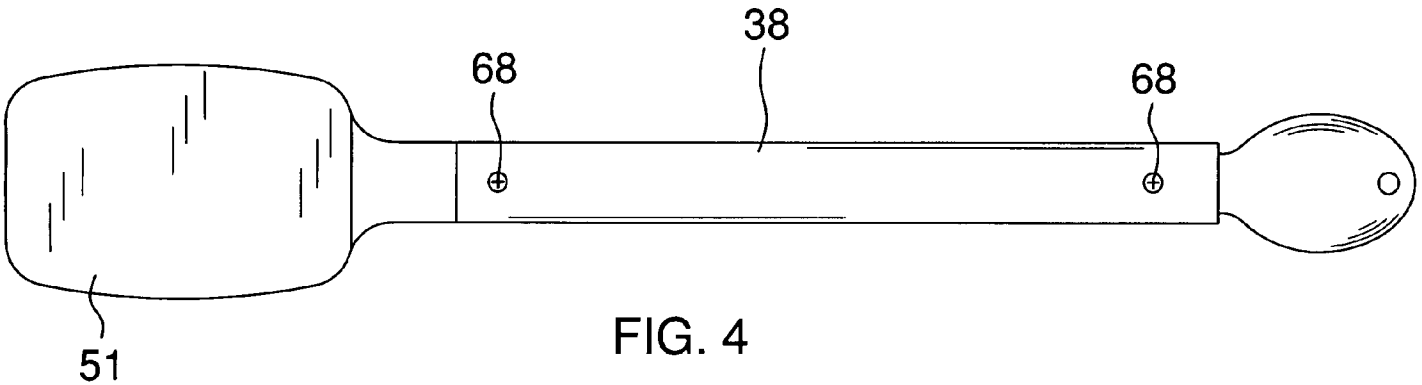
FIG. 4 is a back view of the brush assembly of the present invention.
Figure 5A:
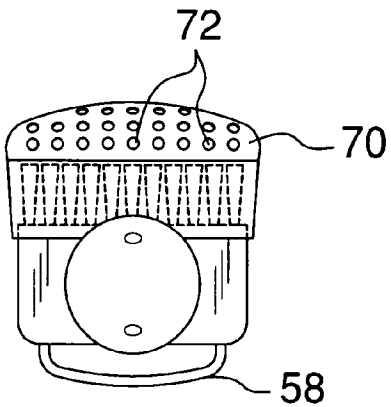
FIG. 5A is a bottom view of the brush assembly of the present invention having an optional pad attachment thereon.
Figure 5:
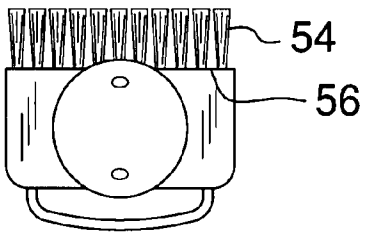
FIG. 5 is a bottom view of the brush assembly of the present invention.
Figure 6A:
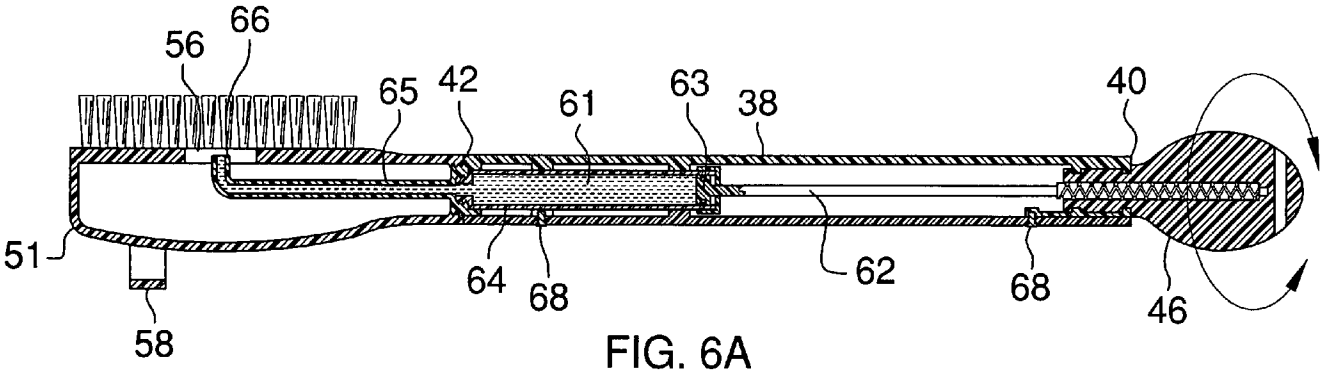
FIG. 6A is a cross-sectional view of the present invention taken along line 6 of FIG. 1.
Figure 6B:
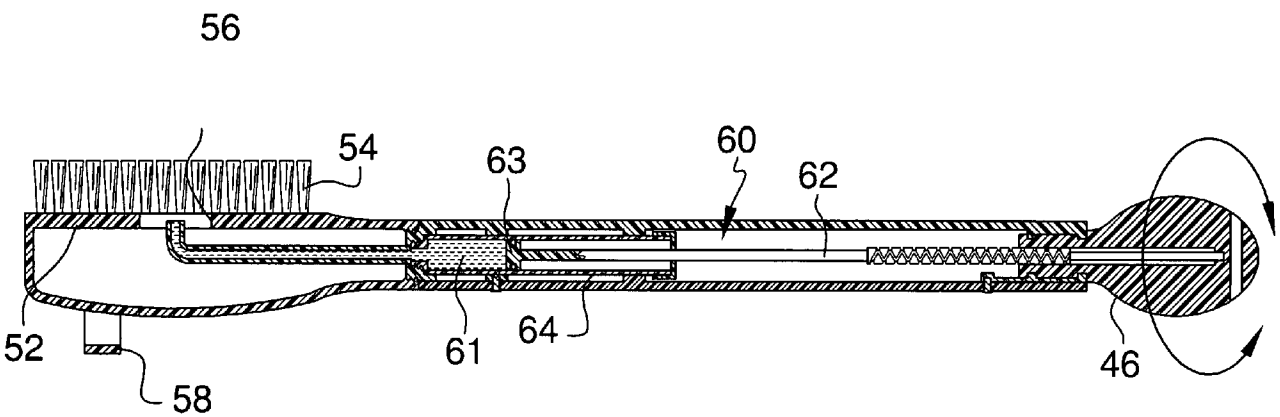
FIG. 6B is a cross-sectional view of the present invention taken along line 6 in FIG. 1 wherein the brush assembly has been actuated.

With reference now to the drawings, and in particular to FIGS. 1 through 7 thereof, a new lotion application device embodying the principles and concepts of the present invention and generally designated by the reference numeral 10 will be described.

As best illustrated in FIGS. 1 through 7, the lotion application apparatus 10 generally comprises a base 12 that has an apex 14. The base 12 includes a plurality legs 16 each having a foot end 18 and a top end 20, wherein the top ends 20 are attached together. The base 12 includes three legs 16 to define a tri-pod. Each of the legs 16 is telescopic and has an adjustable height. A post 22 is attached to and extends upwardly from the apex 14 of the base 12. The post 22 is telescopic and has an adjustable height. A support 24 is attached to a distal end 26 of the post 22 with respect to the base 12. The support 24 is elongated and has a first end 28 and a second end 30. The support 24 is attached to the post 22 between the first 28 and second 30 ends. The support 24 is telescopic and has an adjustable length.

An arm 32 is attached to the second end 30 of the support 24 and extends downwardly from the support 24. A bottom end 34 of the arm 32 comprises a grip. The arm 32 is adjustable with respect to the support 24 to selectively move the grip, or bottom end 34, towards or away from the support 24. The first end 28 of the support comprises a counter weight to the arm 32. The arm 32 is used to rotate the support along a longitudinal axis of the support 24 with respect to the post 22.

A brush assembly 36 is attached to the support 24. The brush assembly 36 includes an elongated tubular member 38 that has an upper end 40 and a lower end 42. A mounting 44 is attached to the upper end 40 and removably engages the tubular member 38 and the support 24. The mounting 44 is positioned between the arm 32 and the post 22. The tubular member 38 is pivoted with the rotation of the support 24. The mounting 44 includes a handle 46 attached to the brush assembly 36, and more particularly the upper end 40, and a pin 48 extending through the handle 46. The pin 48 is attached to a bracket 50 coupled to the support 24. A brush head 51 is removably attached to the lower end 42 of the tubular member 38. The brush head 51 has a vertically oriented face 52 having a plurality of bristles 54 attached thereto. The face 52 has at least one aperture 56 extending therethrough that is fluidly coupled to the tubular member 38. A loop 58 is attached to brush head 51 to hang the brush assembly 36 when not in use.

Figure 7:
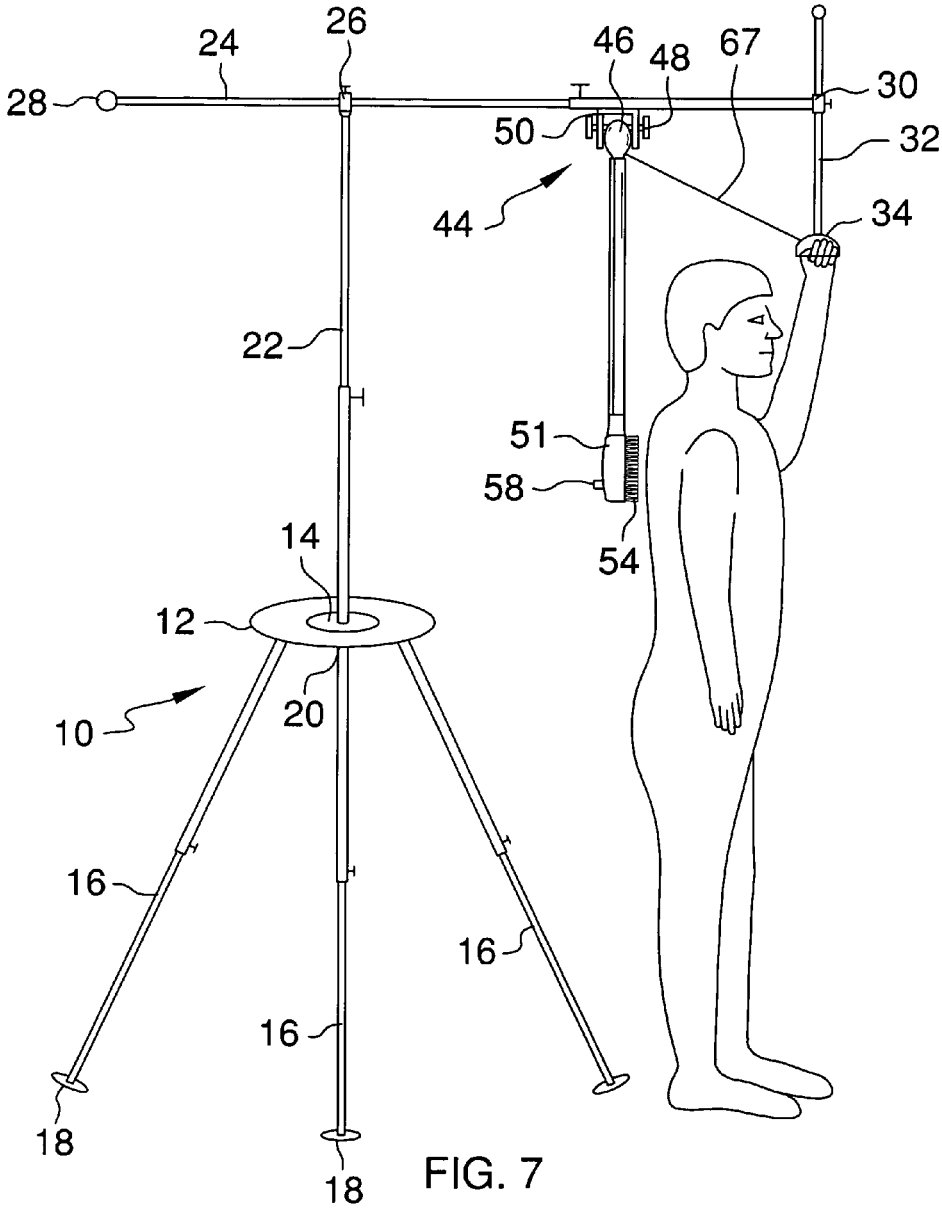
FIG. 7 is an in-use view of the present invention.

A lotion dispensing assembly 60 is mounted within the tubular member 38. The lotion dispensing assembly 60 contains lotion 61. The lotion dispensing assembly 60 is fluidly coupled to the at least one aperture 56 and dispenses lotion 61 through the aperture 56 and onto the bristles 54 when the lotion dispensing assembly 60 is actuated. The lotion dispensing assembly 60 may include the handle 46 being threadably coupled to a rod 62 positioned within the tubular member 38. The end of the rod 62 forms a piston 63 positioned within a sleeve 64. When the handle 46 is rotated, the piston 63 moves within the sleeve 64 to force lotion 61, positioned in the sleeve 64, outwardly of the sleeve 64 and into a tube 65 having a terminal end 66 adjacent to the at least one aperture 56. FIG. 7 shows a second embodiment wherein the handle 46 may be coupled to an actuator 67 that is pulled to actuate a lotion dispensing assembly that includes a squeezable handle.

For persons with sensitive skin, a pad 70 may be removably positioned over the bristles 54. A plurality of openings 72 extends through the pad 70 to receive the lotion therethrough. The pad 70 comprises a resiliently compressible material.

In use, a person adjusts the height of the apparatus 10 to position the brush assembly 36 where needed with respect to their back. The person then actuates the lotion dispenser 60 to dispense lotion onto the brush head 51. The arm 32 is moved back and forth to rotate the brush assembly 36 to spread the lotion on the person's back. The tubular member 38 may be taken apart by removing fasteners 68 therein to refill the sleeve 64 positioned within the tubular member 38. It should be understood that the term lotion includes moisturizing lotion, medicated lotions, sun screening and tanning lotions and other types of ointments that are rubbed into the skin.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A lotion dispensing and application apparatus, said apparatus comprising:

a base having an apex;

a post being attached to and extending upwardly from said apex of said base;

a support being attached to a distal end of said post with respect to said base, said support being elongated and having a first end and a second end, said support being attached to said post between said first and second ends;

an arm being attached to said second end of said support and extending downwardly from said support, a bottom end of said arm comprising a grip, said arm being used to rotate said support along a longitudinal axis of said support with respect to said post; and a brush assembly being mounted to said support for dispensing lotion onto a person.

2. The apparatus according to claim 1, wherein said base includes a plurality legs each having a foot end and a top end, said top ends being attached together, said base including three legs and defining a tri-pod.

3. The apparatus according to claim 2, wherein each of said legs is telescopic and has an adjustable height.

4. The apparatus according to claim 1, wherein said post is telescopic and having an adjustable height.

5. The apparatus according to claim 4, wherein said support is telescopic and having an adjustable length.

6. The apparatus according to claim 5, wherein said arm is adjustable with respect to said support to selectively move said grip towards or away from said support.

7. The apparatus according to claim 6, wherein said first end of said support comprises a counter weight to said arm.

8. The apparatus according to claim 1, wherein said brush assembly comprises:

an elongated tubular member having an upper end and a lower end;

a mounting being attached to said upper end, said mounting removably engaging said tubular member and said support, said mounting being positioned between said arm and said post, said tubular member being pivoted with the rotation of said support;

a brush head being attached to said lower end of said tubular member, said brush head having a vertically oriented face having a plurality of bristles attached thereto, said face having at least one aperture extending therethrough and fluidly coupled to said tubular member; and a lotion dispensing assembly being mounted within said tubular member, said lotion dispensing assembly containing lotion, said lotion dispensing assembly being fluidly coupled to said at least one aperture and dispensing lotion through said aperture and onto said bristles when said lotion dispensing assembly is actuated.

9. The apparatus according to claim 8, wherein said base includes a plurality legs each having a foot end and a top end, said top ends being attached together, said base including three legs and defining a tri-pod.

10. The apparatus according to claim 9, wherein each of said legs is telescopic and has an adjustable height.

11. The apparatus according to claim 8, wherein said post is telescopic and having an adjustable height.

12. The apparatus according to claim 11, wherein said support is telescopic and having an adjustable length.

13. The apparatus according to claim 12, wherein said arm is adjustable with respect to said support to selectively move said grip towards or away from said support.

14. The apparatus according to claim 13, wherein said first end of said support comprises a counter weight to said arm.

15. The apparatus according to claim 1, further including a pad being removably positioned on said brush assembly, a plurality of openings extending through said pad to receive said lotion therethrough, said pad comprising a resiliently compressible material.

16. The apparatus according to claim 8, further including a pad being removably positioned over said bristles, a plurality of openings extending through said pad to receive said lotion therethrough, said pad comprising a resiliently compressible material.

17. A lotion dispensing and application apparatus, said apparatus comprising:

a base having an apex, said base including a plurality of legs each having a foot end and a top end, said top ends being attached together, said base including three legs and defining a tri-pod, each of said legs being telescopic and having an adjustable height;

a post being attached to and extending upwardly from said apex of said base, said post being telescopic and having an adjustable height;

a support being attached to a distal end of said post with respect to said base, said support being elongated and having a first end and a second end, said support being attached to said post between said first and second ends, said support being telescopic and having an adjustable length;

an arm being attached to said second end of said support and extending downwardly from said support, a bottom end of said arm comprising a grip, said arm being adjustable with respect to said support to selectively move said grip towards or away from said support, said first end of said support comprising a counter weight to said arm, said arm being used to rotate said support along a longitudinal axis of said support with respect to said post;

a brush assembly comprising:

an elongated tubular member having an upper end and a lower end;

a mounting being attached to said upper end, said mounting removably engaging said tubular member and said support, said mounting being positioned between said arm and said post, said tubular member being pivoted with the rotation of said support;

a brush head being removably attached to said lower end of said tubular member, said brush head having a vertically oriented face having a plurality of bristles attached thereto, said face having at least one aperture extending therethrough and fluidly coupled to said tubular member; and a lotion dispensing assembly being mounted within said tubular member, said lotion dispensing assembly containing lotion, said lotion dispensing assembly being fluidly coupled to said at least one aperture and dispensing lotion through said aperture and onto said bristles when said lotion dispensing assembly is actuated.

* * * * *